US009285717B2

(12) United States Patent
Tominaga et al.

(10) Patent No.: US 9,285,717 B2
(45) Date of Patent: Mar. 15, 2016

(54) IMAGE FORMING APPARATUS HAVING INCREASED TRANSFER EFFICIENCY

(71) Applicant: FUJI XEROX CO., LTD, Minato-ku, Tokyo (JP)

(72) Inventors: Yoshiyuki Tominaga, Kanagawa (JP); Sho Watanabe, Kanagawa (JP)

(73) Assignee: FUJI XEROX CO., LTD, Tokyo (JP)

( * ) Notice: Subject to any disclaimer, the term of this patent is extended or adjusted under 35 U.S.C. 154(b) by 0 days.

(21) Appl. No.: 14/462,754

(22) Filed: Aug. 19, 2014

(65) Prior Publication Data

US 2015/0220025 A1 Aug. 6, 2015

(30) Foreign Application Priority Data

Feb. 3, 2014 (JP) ..... 2014-018707

(51) Int. Cl.
*G03G 15/16* (2006.01)
*G03G 15/01* (2006.01)

(52) U.S. Cl.
CPC ..... *G03G 15/1605* (2013.01); *G03G 15/0189* (2013.01); *G03G 15/1675* (2013.01)

(58) Field of Classification Search
CPC ..... G03G 15/1675; G03G 15/1605; G03G 15/0131
USPC ..... 399/66, 121, 297, 299, 302
See application file for complete search history.

(56) References Cited

U.S. PATENT DOCUMENTS

2005/0141912 A1* 6/2005 Iwakura ..... G03G 15/1675 399/66
2009/0080924 A1* 3/2009 Kojima ..... G03G 15/0131 399/66
2009/0297183 A1* 12/2009 Miyahara ..... G03G 15/0131 399/44
2013/0266336 A1* 10/2013 Maeda et al. ..... 399/90
2014/0270829 A1* 9/2014 Washington et al. ..... 399/66
2015/0030342 A1* 1/2015 Yoshioka ..... G03G 15/80 399/66

FOREIGN PATENT DOCUMENTS

JP 2011-164372 A 8/2011
JP 2012-189918 A 10/2012
JP 2012-247470 A 12/2012

* cited by examiner

*Primary Examiner* — Francis Gray
(74) *Attorney, Agent, or Firm* — Sughrue Mion, PLLC

(57) ABSTRACT

An image forming apparatus includes a transfer member, plural transfer sections, and a medium transfer section. The transfer member has an endless shape. An image is transferred to the transfer member during circulation of the transfer member. The transfer sections transfer the image to a surface of the transfer member through a first transfer current. The transfer sections include a most-downstream transfer section provided most downstream in a circulation direction of the transfer member. The medium transfer section transfers the image transferred to the transfer member to a recording medium through a second transfer current. A current flows through the most-downstream transfer section even in the case where the image is transferred to the transfer member by at least one of the transfer sections excluding the most-downstream transfer section, and the most-downstream transfer section does not transfer an image to the transfer member.

7 Claims, 9 Drawing Sheets

SPLATTERING
TRANSPORT DIRECTION
SPLATTERING
CURRENT VALUE
LARGE
CHARGE AMOUNT
SMALL

IMAGE FORMING APPARATUS HAVING INCREASED TRANSFER EFFICIENCY

CROSS-REFERENCE TO RELATED APPLICATIONS

This application is based on and claims priority under 35 USC 119 from Japanese Patent Application No. 2014-018707 filed Feb. 3, 2014.

BACKGROUND

Technical Field

The present invention relates to an image forming apparatus.

SUMMARY

According to an aspect of the present invention, there is provided an image forming apparatus including: an endless transfer member to which an image is transferred during circulation of the transfer member; plural transfer sections that transfer the image to a surface of the transfer member through a first transfer current, the transfer sections including a most-downstream transfer section provided most downstream in a circulation direction of the transfer member; and a medium transfer section that transfers the image transferred to the transfer member to a recording medium through a second transfer current, in which a current flows through the most-downstream transfer section even in the case where the image is transferred to the transfer member by at least one of the transfer sections excluding the most-downstream transfer section, and the most-downstream transfer section does not transfer an image to the transfer member.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1A:
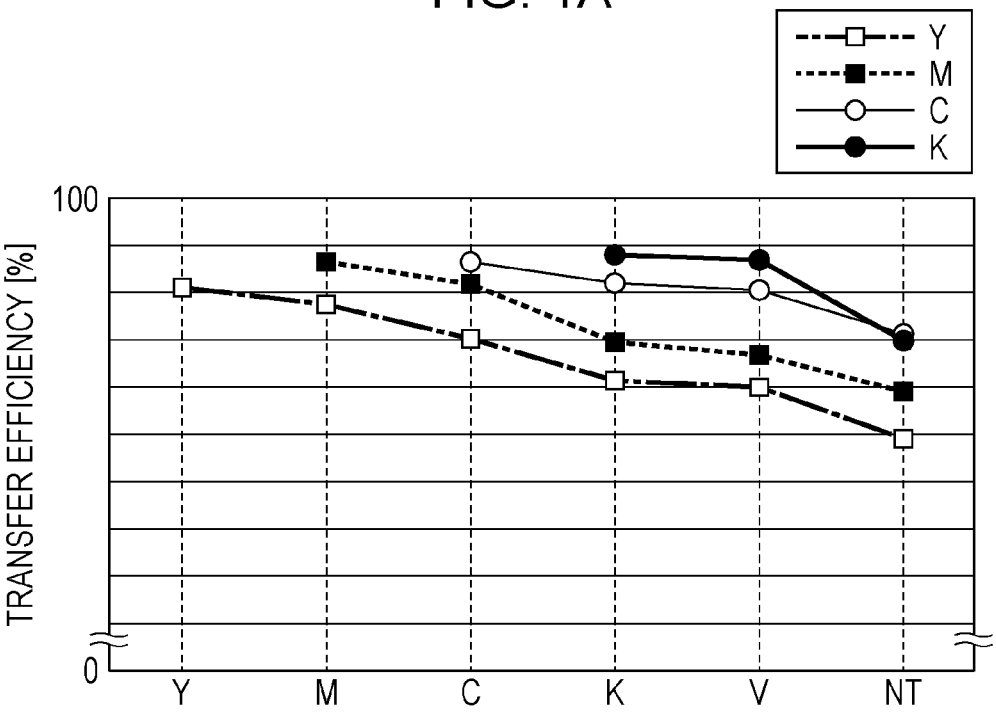
FIGS. 1A and 1B are graphs indicating the transfer efficiency of an image forming apparatus according to a first exemplary embodiment of the present invention and an image forming apparatus according to a comparative embodiment, respectively.

An image forming apparatus according to a first exemplary embodiment of the present invention will be described with reference to FIGS. 1 to 5. In the drawings, the arrow H indicates the vertical direction corresponding to the apparatus height direction, and the arrow W indicates the horizontal direction corresponding to the apparatus width direction.

<Overall Configuration of Image Forming Apparatus>

Figure 5:
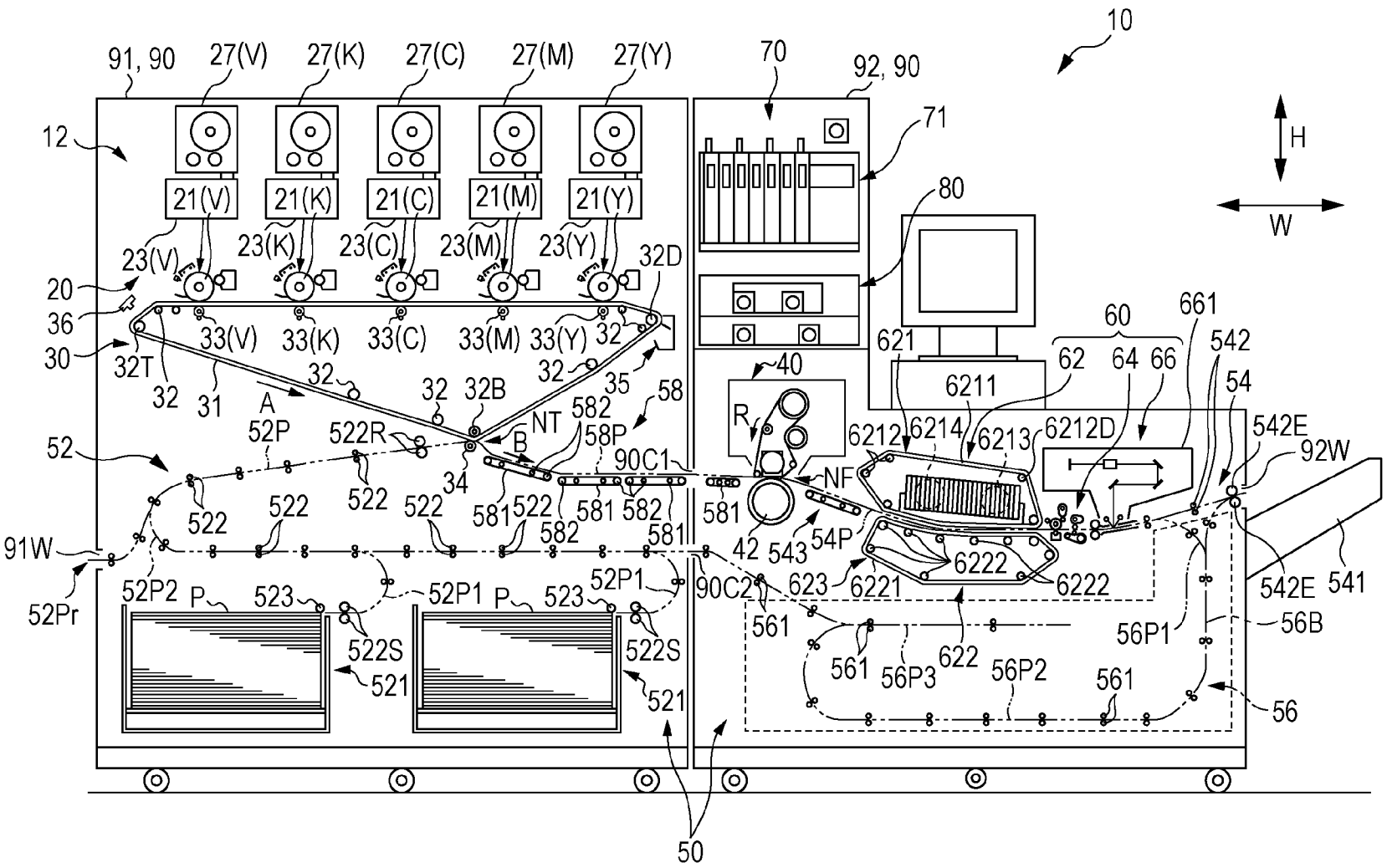
FIG. 5 illustrates a schematic configuration of the image forming apparatus according to the first exemplary embodiment of the present invention.

FIG. 5 is a schematic diagram illustrating an overall configuration of an image forming apparatus 10 as seen from the front side. As illustrated in the drawing, the image forming apparatus 10 includes an image forming section 12 that forms an image on a sheet member P that serves as a recording medium through an electrophotographic system, a medium transport device 50 that transports the sheet member P, and a post-processing section 60 that performs post-processing etc. on the sheet member P on which an image has been formed.

The image forming apparatus 10 also includes a controller 70 that controls the various sections discussed earlier and a power source section 80 to be discussed later, and the power source section 80 which supplies power to the various sections described above including the controller 70.

The image forming section 12 includes a toner image forming section 20 that forms a toner image, a transfer device 30 that transfers the toner image formed by the toner image forming section 20 to the sheet member P, and a fixing device 40 that fixes the toner image transferred to the sheet member P to the sheet member P.

The medium transport device 50 includes a medium supply section 52 that supplies the sheet member P to the image forming section 12, and a medium ejection section 54 that ejects the sheet member P on which the toner image has been formed. The medium transport device 50 also includes a medium return section 56 used to form an image on both surfaces of the sheet member P, and an intermediate transport section 58 to be discussed later.

The post-processing section 60 includes a medium cooling section 62 that cools the sheet member P to which the toner image has been transferred in the image forming section 12, a correction device 64 that corrects curl of the sheet member P, and an image inspection section 66 that inspects the image formed on the sheet member P. The various sections forming the post-processing section 60 are disposed in the medium ejection section 54 of the medium transport device 50.

The various sections of the image forming apparatus 10 are housed in a housing 90 except for an ejected medium receiving section 541 forming the medium ejection section 54 of the medium transport device 50. In the exemplary embodiment, the housing 90 is dividable into a first housing 91 and a second housing 92 that are adjacent to each other in the apparatus width direction. This reduces the transport size of the image forming apparatus 10 in the apparatus width direction.

The first housing 91 houses a principal portion of the image forming section 12 excluding the fixing device 40 to be discussed later, and the medium supply section 52. The second housing 92 houses the fixing device 40 forming the image forming section 12, the medium ejection section 54 excluding the ejected medium receiving section 541, the medium cooling section 62, the image inspection section 66, the medium return section 56, the controller 70, and the power source section 80. The first housing 91 and the second housing 92 are coupled to each other by a fastening unit such as a bolt and a nut (not illustrated), for example. With the first housing 91 and the second housing 92 coupled to each other, a communication opening portion 90C1 for the sheet member P that extends from a transfer nip NT to a fixing nip NF of the image forming section 12 to be discussed later and a communication passage 90C2 for the sheet member P that extends from the medium return section 56 to the medium supply section 52 are formed between the first housing 91 and the second housing 92.

(Image Forming Section)

As discussed earlier, the image forming section 12 includes the toner image forming section 20, the transfer device 30, and the fixing device 40. Plural toner image forming sections 20 are provided to form toner images in respective colors. In the exemplary embodiment, toner image forming sections 20 for five colors, namely a special color (V), yellow (Y), magenta (M), cyan (C), and black (K), are provided. The symbols (V), (Y), (M), (C), and (K) used in FIG. 5 indicate the respective colors described above. The transfer device 30 transfers toner images in the five colors from a transfer belt 31, to which the toner images in the five colors superimposed on each other have been transferred through a first transfer, to the sheet member P at the transfer nip NT (as discussed in detail later).

In the exemplary embodiment, for example, the special color (V) is a corporate color specific to a user that is used frequently compared to the other colors.

[Toner Image Forming Section]

Figure 3:
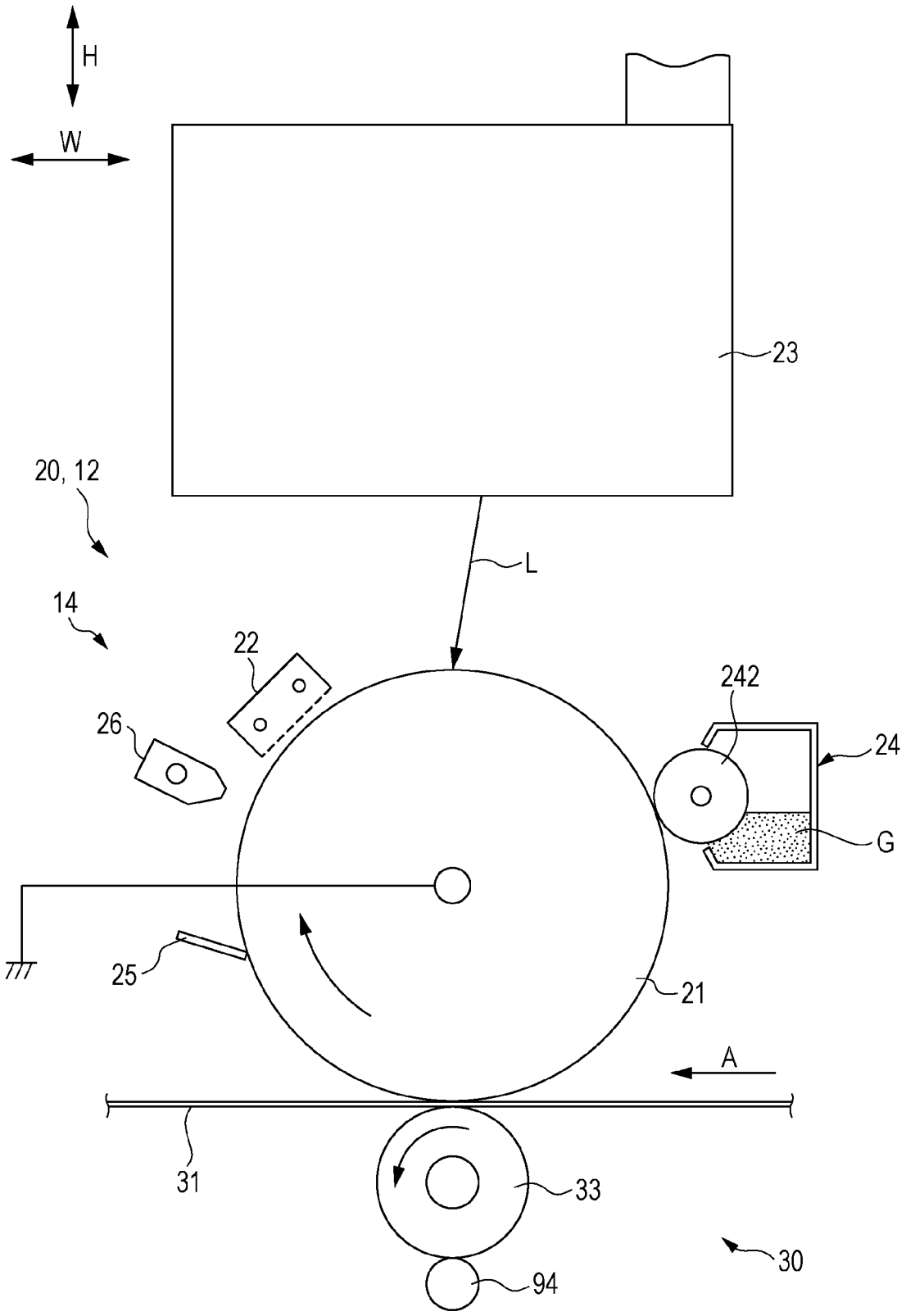
FIG. 3 illustrates the configuration of an image forming unit used in the image forming apparatus according to the first exemplary embodiment of the present invention.

The toner image forming sections 20 for the respective colors are basically formed in the same manner except for the toners to be used. Thus, image forming units 14 for the respective colors will be described below without being specifically differentiated from each other. As illustrated in FIG. 3, the image forming unit 14 of the toner image forming section 20 includes a photosensitive drum 21 that serves as an example of an image holding element, a charging unit 22, an exposure device 23, a developing device 24 that serves as an example of a developing unit, a cleaning device 25, and a static eliminating device 26.

[Photosensitive Drum]

The photosensitive drum 21 is formed in a cylindrical shape, grounded, and driven by a drive unit (not illustrated) so as to rotate about its own axis. A photosensitive layer that provides a negative charging polarity, for example, is formed on the surface of the photosensitive drum 21. As illustrated in FIG. 5, the photosensitive drums 21 for the respective colors are disposed in line with each other along the apparatus width direction as seen from the front.

[Charging Unit]

As illustrated in FIG. 3, the charging unit 22 charges the surface (photosensitive layer) of the photosensitive drum 21 to a negative polarity. In the exemplary embodiment, the charging unit 22 is a scorotron charging unit of a corona discharge type (non-contact charging type).

[Exposure Device]

The exposure device 23 forms an electrostatic latent image on the surface of the photosensitive drum 21. Specifically, the exposure device 23 radiates modulated exposure light L to the surface of the photosensitive drum 21, which has been charged by the charging unit 22, in accordance with image data received from an image signal processing section 71 (see FIG. 5) that forms the controller 70. An electrostatic latent image is formed on the surface of the photosensitive drum 21 by the exposure light L radiated by the exposure device 23.

[Developing Device]

The developing device 24 develops the electrostatic latent image formed on the surface of the photosensitive drum 21 as a toner image using a developer G containing a toner and a carrier to form a toner image on the surface of the photosensitive drum 21. The developing device 24 is supplied with the toner from a toner cartridge 27 that stores the toner.

[Cleaning Device]

The cleaning device 25 is formed as a blade that scrapes off a toner that remains on the surface of the photosensitive drum 21 after the toner image is transferred to the transfer device 30 from the surface of the photosensitive drum 21.

[Static Eliminating Device]

The static eliminating device 26 eliminates static by radiating light to the photosensitive drum 21 after the transfer. This causes the charging history of the surface of the photosensitive drum 21 to be canceled.

[Transfer Device]

The transfer device 30 performs a first transfer of the toner images on the photosensitive drums 21 for the respective colors onto the transfer belt 31, which is an example of a transfer member, as superimposed on each other, and performs a second transfer of the superimposed toner images onto the sheet member P. The transfer device 30 will be specifically described below.

[Transfer Belt]

Figure 4:
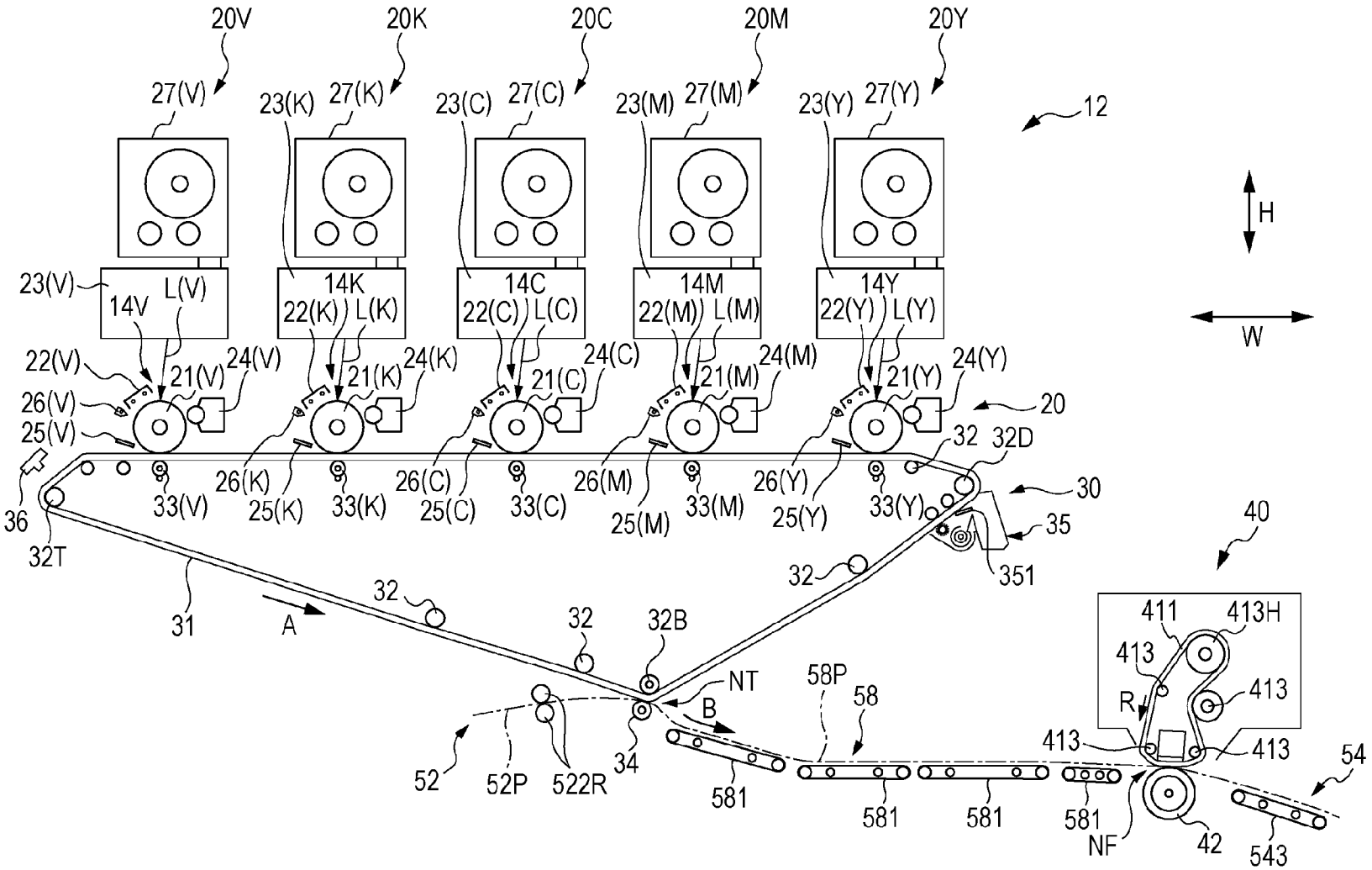
FIG. 4 illustrates the configuration of the image forming section of the image forming apparatus according to the first exemplary embodiment of the present invention.

As illustrated in FIG. 4, the transfer belt 31 has an endless shape, and is wound around plural rollers 32 to determine its posture. In the exemplary embodiment, the transfer belt 31 has a posture of an inverted obtuse triangle that is long in the apparatus width direction as seen from the front. Of the plural rollers 32, a roller 32D illustrated in FIG. 4 functions as a drive roller that applies power of a motor (not illustrated) to circulate the transfer belt 31 in the direction of the arrow A.

Of the plural rollers 32, a roller 32T illustrated in FIG. 4 functions as a tension applying roller that applies a tension to the transfer belt 31. Of the plural rollers 32, a roller 32B illustrated in FIG. 4 is grounded, and functions as a counter roller for a second transfer roller 34 to be discussed later. The lower-end vertex of the transfer belt 31, which forms the obtuse angle of the transfer belt 31 in the posture of an inverted obtuse triangle as discussed earlier, is wound around the roller 32B. The upper side of the transfer belt 31 which extends in the apparatus width direction with the transfer belt 31 in the posture discussed earlier contacts the photosensitive drums 21 for the respective colors from below.

[First Transfer Roller]

First transfer rollers 33 that transfer the toner image on each photosensitive drum 21 to the transfer belt 31 are disposed inside the transfer belt 31. The first transfer rollers 33 are disposed opposite to the photosensitive drums 21 for the corresponding colors across the transfer belt 31. The first transfer rollers 33 are applied with a transfer bias that is opposite in polarity to the toner polarity from a power feed section (not illustrated). Application of the transfer bias causes a first transfer current to flow from the first transfer roller 33 toward the photosensitive drum 21 so that the toner image formed on the photosensitive drum 21 is transferred to the transfer belt 31.

Specifically, a power feed member (not illustrated) is provided for each of the first transfer rollers 33 to apply a voltage to each of the first transfer rollers 33. The power feed member applies a transfer bias to the first transfer roller 33 so that a first transfer current flows from the first transfer roller 33 toward the photosensitive drum 21. The first transfer current causes the toner image constituted of a toner charged to a negative polarity and formed on the photosensitive drum 21 to be transferred to the transfer belt 31.

As described above, the first transfer rollers 33Y, 33M, 33C, and 33K, which transfer the toner images in yellow (Y), magenta (M), cyan (C), and black (K) to the surface of the transfer belt 31 through the first transfer current, are an example of a transfer section.

Further, the first transfer roller 33V, which transfers the image in the special color (V) which is different from yellow (Y), magenta (M), cyan (C), and black (K) to the surface of the transfer belt 31 through the first transfer current, is an example of a most-downstream transfer section and the transfer section.

[Second Transfer Roller]

The transfer device 30 also includes the second transfer roller 34 which serves as a medium transfer section that transfers the superimposed toner images on the transfer belt 31 to the sheet member P. The second transfer roller 34 is disposed with the transfer belt 31 interposed between the roller 32B and the second transfer roller 34 to form the transfer nip NT between the transfer belt 31 and the second transfer roller 34. The sheet member P is supplied to the transfer nip NT from the medium supply section 52 at an appropriate timing. The second transfer roller 34 is applied with a transfer bias that is opposite in polarity to the toner polarity by a power supply section (not illustrated). Application of the transfer bias causes a second transfer current to flow from the second transfer roller 34 toward the roller 32B so that the toner image on the transfer belt 31 is transferred to the sheet member P which passes through the fixing nip NT.

[Cleaning Device]

The transfer device 30 further includes the cleaning device 35 which cleans the transfer belt 31 after the second transfer. The cleaning device 35 is disposed downstream of the location at which the second transfer is performed (the transfer nip NT) and upstream of the location at which the first transfer is performed in the circulation direction of the transfer belt 31. The cleaning device 35 includes a blade 351 that scrapes off a toner that remains on the surface of the transfer belt 31 from the surface of the transfer belt 31.

A static eliminating device (not illustrated) that eliminates static from the transfer belt 31 is disposed adjacent to the cleaning device 35.

[Fixing Device]

The fixing device 40 fixes the toner images transferred to the sheet member P in the transfer device 30 to the sheet member P. In the exemplary embodiment, the fixing device 40 is configurated to fix the toner images to the sheet member P by heating and pressurizing the toner images at the fixing nip NF formed by a fixing belt 411 wound around plural rollers 413 and a pressurizing roller 42. A roller 413H serves as a heating roller that includes a built-in heater, for example, and that is rotated by a drive force transmitted from a motor (not illustrated). This causes the fixing belt 411 to be circulated in the direction of the arrow R.

The pressurizing roller 42 is also rotated by a drive force transmitted from a motor (not illustrated) at a peripheral velocity that is generally the same as the peripheral velocity of the fixing belt 411.

(Medium Transport Device)

As illustrated in FIG. 5, the medium transport device 50 includes the medium supply section 52, the medium ejection section 54, the medium return section 56, and the intermediate transport section 58.

[Medium Supply Section]

The medium supply section 52 includes a container 521 that stores the sheet members P stacked on each other. In the exemplary embodiment, two containers 521 are disposed side by side along the apparatus width direction below the transfer device 30.

A medium supply passage 52P is formed by plural transport roller pairs 522, guides (not illustrated), and so forth to extend from each container 521 to the transfer nip NT as the second transfer position. The medium supply passage 52P is turned back in the apparatus width direction at two turning portions 52P1 and 52P2 while being raised to form a shape that leads to the transfer nip NT (a generally "S" shape).

A feed roller 523 that feeds the uppermost one of the sheet members P stored in the container 521 is disposed on the upper side of each container 521. Of the plural transport roller pairs 522, a transport roller pair 522S on the most upstream side in the transport direction of the sheet member P functions as separation rollers that separate the sheet members P fed from the container 521 by the feed roller 523 in a superposed state from each other. Of the plural transport roller pairs 522, a transport roller pair 522R positioned immediately upstream of the transfer nip NT in the transport direction of the sheet member P operates such that the timing of movement of the toner images on the transfer belt 31 and the timing of transport of the sheet member P match each other.

The medium supply section 52 includes a preliminary transport passage 52Pr. The preliminary transport passage 52Pr starts at an opening portion 91W of the first housing 91 provided opposite to the second housing 92 to be merged with the turning portion 52P2 of the medium supply passage 52P. The preliminary transport passage 52Pr serves as a transport passage that feeds the sheet member P fed from an optional recording medium supply device (not illustrated) disposed adjacent to the opening portion 91W of the first housing 91 to the image forming section 12.

[Intermediate Transport Section]

As illustrated in FIG. 4, the intermediate transport section 58 is disposed to extend from the transfer nip NT of the transfer device 30 to the fixing nip NF of the fixing device 40, and includes plural belt transport members 581 that each include an endless transport belt wound around rollers.

The intermediate transport section 58 transports the sheet member P by circulating the transport belt with the belt transport members 581 suctioning air (to generate a negative pressure) to draw the sheet member P to the surface of the transport belt.

[Medium Ejection Section]

As illustrated in FIG. 5, the medium ejection section 54 ejects the sheet member P to which the toner images have been fixed by the fixing device 40 of the image forming section 12 to the outside of the housing 90 from an ejection port 92W formed at an end portion of the second housing 92 opposite to the first housing 91.

The medium ejection section 54 includes an ejected medium receiving section 541 that receives the sheet member P ejected from the ejection port 92W.

The medium ejection section 54 has a medium ejection passage 54P through which the sheet member P is transported from the fixing device 40 (the fixing nip NF) to the ejection port 92W. The medium ejection passage 54P is formed from a belt transport member 543, plural roller pairs 542, guides (not illustrated), and so forth. Of the plural roller pairs 542, a roller pair 542E disposed on the most downstream side in the ejection direction of the sheet member P functions as ejection rollers that eject the sheet member P onto the ejected medium receiving section 541.

[Medium Return Section]

The medium return section 56 includes plural roller pairs 561. The plural roller pairs 561 form a reverse passage 56P to which the sheet member P having passed through the image inspection section 66 is fed in the case where there is a request to form an image on both surfaces of the sheet member P. The reversal passage 56P has a branch path 56P1, a transport path 56P2, and a reverse path 56P3. The branch path 56P1 is branched from the medium ejection passage 54P. The transport path 56P2 feeds the sheet member P received from the branch path 56P1 to the medium supply passage 52P. The reverse path 56P3 is provided in the middle of the transport path 56P2, and reverses the front and back sides of the sheet member P by changing the transport direction of the sheet member P transported through the transport path 56P2 into the opposite direction (through switchback transport).

(Post-Processing Section)

The medium cooling section 62, the correction device 64, and the image inspection section 66 which form the post-processing section 60 are disposed on a portion of the medium ejection passage 54P of the medium ejection section 54 provided upstream of the branch portion of the branch path 56P1 in the ejection direction of the sheet member P, and arranged sequentially in the order in which they are mentioned from the upstream side in the ejection direction.

[Medium Cooling Section]

The medium cooling section 62 includes a heat absorbing device 621 that absorbs heat of the sheet member P, and a pressing device 622 that presses the sheet member P against the heat absorbing device 621. The heat absorbing device 621 is disposed on the upper side of the medium ejection passage 54P. The pressing device 622 is disposed on the lower side of the medium ejection passage 54P.

The heat absorbing device 621 includes an endless heat absorbing belt 6211, plural rollers 6212 that support the heat absorbing belt 6211, a heat sink 6213 disposed on the inner side of the heat absorbing belt 6211, and a fan 6214 that cools the heat sink 6213.

The outer peripheral surface of the heat absorbing belt 6211 contacts the sheet member P so as to be able to exchange heat with the sheet member P. Of the plural rollers 6212, a roller 6212D functions as a drive roller that transmits a drive force to the heat absorbing belt 6211. The heat sink 6213 makes slidable surface contact with the inner peripheral surface of the heat absorbing belt 6211 over a predetermined range along the medium ejection passage 54P.

The pressing device 622 includes an endless pressing belt 6221, and plural rollers 6222 that support the pressing belt 6221. The pressing belt 6221 is wound around the plural rollers 6222. The pressing device 622 transports the sheet member P together with the heat absorbing belt 6211 while pressing the sheet member P against the heat absorbing belt 6211 (the heat sink 6213).

[Correction Device]

The correction device 64 is provided downstream of the medium cooling section 62 in the medium ejection section 54. The correction device 64 corrects curl of the sheet member P received from the medium cooling section 62.

[Image Inspection Section]

An in-line sensor 661 that forms a principal portion of the image inspection section 66 is disposed downstream of the correction device 64 in the medium ejection section 54. The in-line sensor 661 detects the presence or absence of, and the degree of, a defect in toner concentration, an image defect, a defect in image position, and so forth of the fixed toner image on the basis of light radiated to the sheet member P and reflected from the sheet member P.

<Image Forming Operation (Effect) of Image Forming Apparatus>

Next, an overview of an image forming process and a post-processing process performed on the sheet member P by the image forming apparatus 10 will be described.

As illustrated in FIG. 5, when an image forming instruction is received, the controller 70 actuates the toner image forming section 20, the transfer device 30, and the fixing device 40. This rotates the photosensitive drum 21 of the image forming unit 14 and a developing roller 242 of the developing device 24 for each color to circulate the transfer belt 31 as illustrated in FIG. 4. This also rotates the pressurizing roller 42 to circulate the fixing belt 411. In synchronization with these operations, the controller 70 further actuates the medium transport device 50 and so forth.

This causes the photosensitive drum 21 for each color to be charged by the charging unit 22 while being rotated. The controller 70 sends image data to be subjected to image processing performed by the image signal processing section 71 to each exposure device 23. The exposure device 23 outputs exposure light L in accordance with the image data to expose the charged photosensitive drum 21 to the light. Then, an electrostatic latent image is formed on the surface of the photosensitive drum 21. The electrostatic latent image formed on the photosensitive drum 21 is developed using a developer supplied from the developing device 24. Consequently, a toner image in the corresponding color among the special color (V), yellow (Y), magenta (M), cyan (C), and black (K) is formed on the photosensitive drum 21 for each color.

The toner images in the respective colors formed on the photosensitive drums 21 for the respective colors are sequentially transferred to the circulating transfer belt 31 by applying a transfer bias through the first transfer rollers 33 for the respective colors. This causes a superimposed toner image obtained by superimposing the toner images in the five colors to be formed on the transfer belt 31. The superimposed toner image is transported to the transfer nip NT by the circulation of the transfer belt 31.

As illustrated in FIG. 5, the sheet member P is supplied to the transfer nip NT by the transport roller pair 522R of the medium supply section 52 at a timing that matches the transport of the superimposed toner image. Application of the transfer bias at the transfer nip NT causes the superimposed toner image to be transferred from the transfer belt 31 to the sheet member P.

The sheet member P to which the toner image has been transferred is transported by the intermediate transport section 58 from the transfer nip NT of the transfer device 30 to the fixing nip NF of the fixing device 40. The fixing device 40 applies heat and a pressure to the sheet member P passing through the fixing nip NF. This causes the transferred toner image to be fixed to the sheet member P.

The sheet member P ejected from the fixing device 40 is processed by the post-processing section 60 while being transported by the medium ejection section 54 to the ejected medium receiving section 541 outside the apparatus. The sheet member P heated in the fixing process is first cooled in the medium cooling section 62. Then, the sheet member P is corrected for its curl by the correction device 64. The image inspection section 66 detects the presence or absence of, and the degree of, a defect in toner concentration, an image defect, a defect in image position, and so forth of the toner image fixed to the sheet member P. The sheet member P is ejected to the medium ejection section 54.

Meanwhile, in the case where an image is to be formed on a non-image surface of the sheet member P on which no image is formed (in the case of double-sided printing), the controller 70 switches the transport passage for the sheet member P after passing through the image inspection section 66 from the medium ejection passage 54P of the medium ejection section 54 to the branch path 56P1 of the medium return section 56. This causes the sheet member P to be fed to the medium supply passage 52P with its front and back sides reversed by way of the reverse passage 56P. An image is formed (fixed) on the back surface of the sheet member P in the same process as the image forming process performed on the front surface discussed earlier. The sheet member P is ejected by the medium ejection section 54 to the ejected medium receiving section 541 outside the apparatus through the same process as the process performed after an image is formed on the front surface discussed earlier.

<Configuration of Principal Portion>

Next, the position at which the image forming unit 14V for the special color (V) is disposed, the positions at which the image forming units 14 for yellow (Y), magenta (M), cyan (C), and black (K) (hereinafter occasionally referred to simply as "regular colors") are disposed, control performed by the controller 70 to transfer the toner images formed on the photosensitive drums 21 to the transfer belt 31, and so forth will be described.

(Arrangement of Image Forming Units)

As illustrated in FIG. 4, the image forming unit 14V for the special color (V) is disposed downstream of all the image forming units 14 for the regular colors and upstream of the fixing nip NT in the circulation direction of the transfer belt 31. Further, the image forming units 14 for the regular colors are disposed in the order of the image forming units 14Y, 14M, 14C, and 14K in the circulation direction of the transfer belt 31.

That is, among the image forming units 14 for the regular colors, the image forming unit 14K for black (K) is disposed most downstream in the circulation direction of the transfer belt 31. The image forming unit 14V for the special color (V) is disposed downstream of the image forming unit 14K for black (K) in the circulation direction of the transfer belt 31.

Similarly, the first transfer rollers 33 are disposed in the order of yellow (Y), magenta (M), cyan (C), black (K), and the special color (V) from the upstream side in the circulation direction of the transfer belt 31.

(Controller)

The controller 70 controls a power feed member (not illustrated) so as to apply a voltage (in the exemplary embodiment, a positive voltage) to the first transfer roller 33V to cause a current to flow from the first transfer roller 33V toward the photosensitive drum 21V even in the case where a toner image in the special color (V) is not formed and a toner image in the special color (V) is not transferred to the transfer belt 31.

The current that flows from the first transfer roller 33V toward the photosensitive drum 21V (the current that flows through the first transfer roller 33V) is reduced compared to the transfer current that flows from each first transfer roller 33 toward each photosensitive drum 21 for the regular colors in the case where toner images formed in the regular colors are transferred to the transfer belt 31. In the exemplary embodiment, the transfer current that flows from each first transfer roller 33 to each photosensitive drum 21 for the regular colors is 45 [μA], for example. In contrast, the current that flows from the first transfer roller 33V toward the photosensitive drum 21V in the case where a toner image in the special color (V) is not transferred to the transfer belt 31 is 27 [μA], for example.

<Effect of Principal Portion>

Formation of toner images with use of yellow (Y), magenta (M), cyan (C), and black (K) and without use of the special color (V) will be described.

In the case where toner images are formed using yellow (Y), magenta (M), cyan (C), and black (K), electrostatic latent images formed on the photosensitive drums 21 of the image forming units 14 for the regular colors are developed using a developer supplied from the developing device 24. Consequently, toner images in yellow (Y), magenta (M), cyan (C), and black (K) are formed on the photosensitive drums 21 for the regular colors (see FIG. 4).

The toner images formed on the photosensitive drums 21 for the regular colors are sequentially transferred to the circulating transfer belt 31 through a transfer current that flows from each first transfer roller 33 to each photosensitive drum 21. This causes a superimposed toner image obtained by superimposing the toner images in the four colors to be formed on the transfer belt 31.

The superimposed toner image is transported by the circulating transfer belt 31 to pass between the photosensitive drum 21V and the first transfer roller 33V for the special color (V). When the superimposed toner image passes between the photosensitive drum 21V and the first transfer roller 33V for the special color, a current that flows from the first transfer roller 33V toward the photosensitive drum 21V flows through the superimposed toner image.

When a toner image in yellow (Y) transferred onto the transfer belt 31 passes between the photosensitive drums 21 and the first transfer rollers 33 for magenta (M), cyan (C), black (K), and the special color (V), a current that flows from each first transfer roller 33 toward each photosensitive drum 21 flows through the toner image in yellow (Y). This increases the charge amount of the toner constituting the toner image in yellow compared to that before the toner image passes between the photosensitive drums 21 and the first transfer rollers 33.

Similarly, the charge amount of the toner constituting the toner images in magenta (M) and cyan (C) is also increased when the toner images in magenta (M) and cyan (C) pass between the photosensitive drums 21 and the first transfer rollers 33 provided downstream in the circulation direction of the transfer belt 31.

Further, the toner image in black (K) transferred to the transfer belt 31 by the first transfer roller 33K for black (K), which is disposed most downstream in the circulation direction of the transfer belt 31 among the first transfer rollers 33 for the regular colors, also passes between the photosensitive drum 21V and the first transfer roller 33V for the special color (V) provided downstream in the circulation direction of the transfer belt 31. Consequently, a current that flows from the first transfer roller 33V toward the photosensitive drum 21V flows through the toner image in black (K). This increases the charge amount of the toner constituting the toner image in black (K).

In this way, the charge amount of the toners constituting the toner images in yellow (Y), magenta (M), cyan (C), and black (K) is increased.

The superimposed toner image constituted by the toners, the charge amount of which has been increased, is transported to the transfer nip NT by the circulation of the transfer belt 31. At the fixing nip NT, the superimposed toner image on the transfer belt 31 is transferred to the transported sheet member P through a transfer current that flows from the second transfer roller 34 toward the roller 32B.

<Comparison between Exemplary Embodiment and Comparative Embodiment>

Next, a comparison is made between the exemplary embodiment and a comparative embodiment in which a current does not flow through the toner images in the regular colors constituted on the transfer belt 31 when the toner images pass between the photosensitive drum 21V and the first transfer roller 33V for the special color (V) in the case where a toner image in the special color (V) is not formed.

Figure 2A:
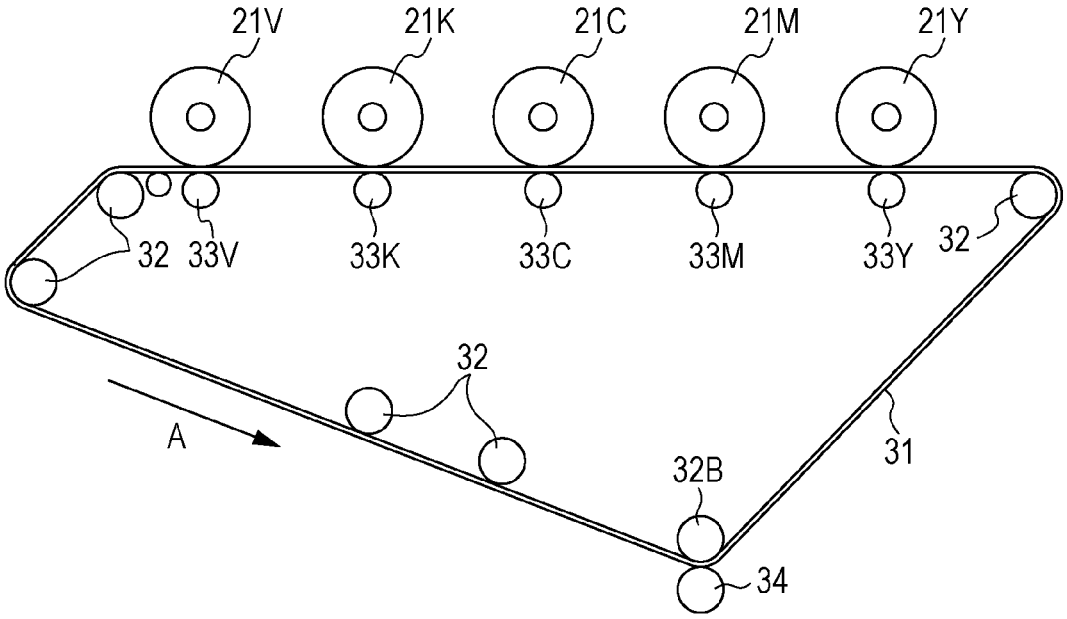
FIGS. 2A and 2B illustrate a schematic configuration of an image forming section of the image forming apparatus according to the first exemplary embodiment of the present invention and the image forming apparatus according to the comparative embodiment, respectively.
Figure 2B:
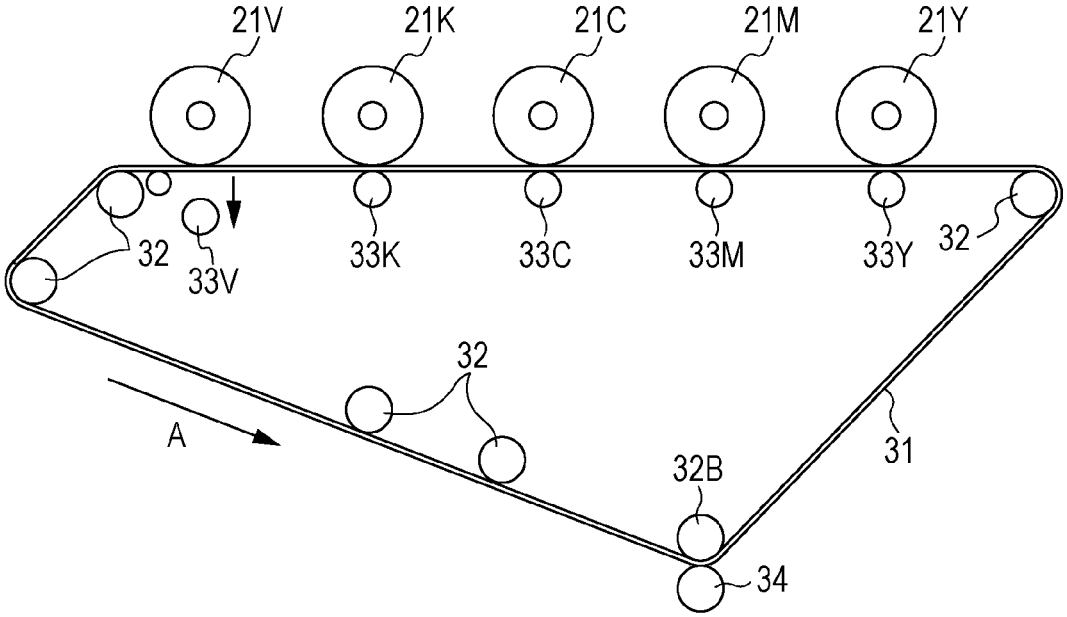

FIG. 2B illustrates the first transfer rollers 33, the transfer belt 31, and so forth according to the comparative embodiment. FIG. 2A illustrates the first transfer rollers 33, the transfer belt 31, and so forth according to the exemplary embodiment.

In the comparative embodiment, as illustrated in FIG. 2B, in the case where toner images are formed using yellow (Y), magenta (M), cyan (C), and black (K) and without using the special color (V), the first transfer roller 33V for the special color (V) is spaced from the transfer belt 31 by a contacting/separating unit (not illustrated). A voltage is not applied to the first transfer roller 33V from a power feed member (not illustrated).

Therefore, a current that flows from the first transfer roller 33V toward the photosensitive drum 21V does not flow through the toner image transferred to the transfer belt 31 by the first transfer roller 33K for black (K). This does not increase the charge amount of the toner constituting the toner image in black (K). Then, with the charge amount of the toner constituting the toner image in black (K) not increased, the superimposed toner image is transferred to the sheet member P through a transfer current that flows from the second transfer roller 34 toward the roller 32B.

In the exemplary embodiment, on the other hand, as illustrated in FIG. 2A, in the case where toner images are formed using yellow (Y), magenta (M), cyan (C), and black (K) and without using the special color (V), the first transfer roller 33V for the special color (V) is in contact with the transfer belt 31. As discussed earlier, a current flows from the first transfer roller 33V toward the photosensitive drum 21V. Therefore, the charge amount of the toner constituting the toner image in black (K) is increased when the toner image in black (K) on the transfer belt 31 passes between the photosensitive drum 21V and the first transfer roller 33V for the special color (V). Then, with the charge amount of the toner constituting the toner image in black (K) increased, the superimposed toner image is transferred to the sheet member P through a transfer current that flows from the second transfer roller 34 toward the roller 32B.

The results of evaluating the transfer efficiency at which the toner images in the respective colors are transferred to the transfer belt 31 or the sheet member P using the configuration according to the comparative embodiment and the transfer efficiency at which the toner images in the respective colors are transferred to the transfer belt 31 or the sheet member P using the configuration according to the exemplary embodiment will be described using FIGS. 1A and 1B.

A first transfer efficiency (%) to be described below is calculated using the following formula (1). An overall transfer efficiency is calculated using the following formula (2).

"First transfer efficiency (%)"=100×(mass of toner on fixing belt after transfer (after passage))/(mass of toner on photosensitive drum before transfer) (1)

"Overall transfer efficiency (%)"=100×(mass of toner transferred to sheet member *P*)/(mass of toner on photosensitive drum before transfer) (2)

The mass of the toner may be obtained by affixing the toner to an adhesive tape or the like and measuring the mass of the adhesive tape to which the toner has been affixed, for example.

FIG. 1A is a graph indicating the transfer efficiency for a case where the configuration according to the exemplary embodiment is used. FIG. 1B is a graph indicating the transfer efficiency for a case where the configuration according to the comparative embodiment is used. In the graphs, the vertical axis indicates the transfer efficiency, and the horizontal axis indicates the transfer position.

In the graphs, the horizontal axis indicates transfer positions such as a position at which the toner image in yellow (Y) is transferred to the transfer belt 31, a position at which the toner image in magenta (M) is transferred to the transfer belt 31, a position at which the toner image in cyan (C) is transferred to the transfer belt 31, and a position at which the toner image in black (K) is transferred to the transfer belt 31, arranged in this order from the left side of the graph. In the graph of FIG. 1A, the symbol "V" provided on the right side of black (K) on the horizontal axis indicates a position at which the first transfer roller 33V for the special color (V) contacts the transfer belt 31.

Figure 1B:
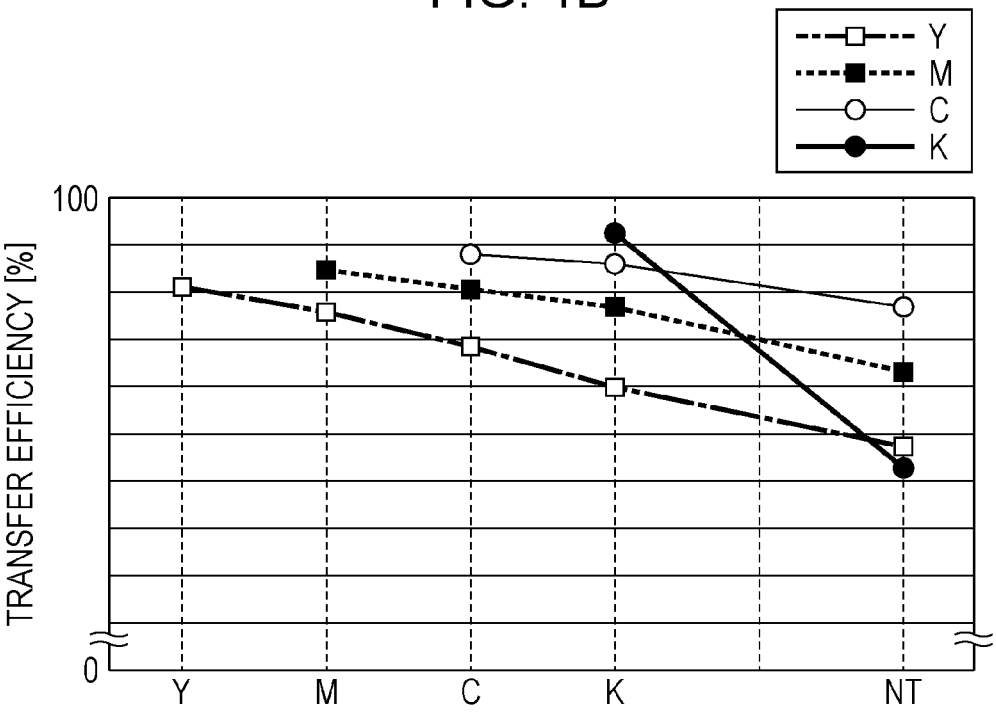

In the graphs of FIGS. 1A and 1B, further, the symbol "NT" at the right end of the horizontal axis indicates a position at which the superimposed toner image on the transfer belt 31 is transferred to the sheet member P. Hereinafter, the positions on the horizontal axis of each graph may be referred to simply as Y position, M position, C position, K position, (V position,) and NT position, arranged from the left side of the graph. In the configuration according to the comparative embodiment, the first transfer roller 33V for the special color (V) is spaced from the transfer belt 31. Therefore, a V position is not indicated on the horizontal axis of the graph for the configuration according to the comparative embodiment in FIG. 1B.

For the transfer efficiency indicated at the Y position, a first transfer efficiency at which the toner image in yellow (Y) is transferred to the transfer belt 31 is indicated. When the toner image in yellow (Y) on the transfer belt 31 passes through the M position, the C position, and the K position (and the V position), the polarity of the toners etc. is varied, and such toners etc. are electrostatically adsorbed by the respective photosensitive drums 21. Consequently, as indicated by the line in the graph, the first transfer efficiency of the toner image in yellow (Y) on the transfer belt 31 is reduced when the toner image passes through the M position, the C position, and the K position (and the V position).

For the transfer efficiency indicated at the NT position, an overall transfer efficiency at which the toner image in yellow (Y) is transferred to the sheet member P is indicated. Some of the toner constituting the toner image in yellow (Y) on the transfer belt 31 is not transferred to the sheet member P at the NT position, but remains on the transfer belt 31. Consequently, as indicated by the line in the graph, the overall transfer efficiency of the toner image in yellow (Y) is reduced at the NT position.

Also for the toner images in magenta (M), cyan (C), and black (K), as indicated by the lines in the graph, the first transfer efficiency and the overall transfer efficiency are reduced as for the toner image in yellow (Y).

Comparative Embodiment

In the comparative embodiment, as seen from the graph illustrated in FIG. 1B, the overall transfer efficiency for the toner image in black (K) is lower than the overall transfer efficiency for the toner images in the other colors. The toner image in black (K) transferred onto the transfer belt 31 is transferred to the transfer belt 31 at a most downstream position in the circulation direction of the transfer belt 31. Therefore, a current that flows from the first transfer rollers 33 toward the photosensitive drums 21 for the other regular colors does not flow through the toner image in black (K). This does not increase the charge amount of the toner constituting the toner image in black (K). Therefore, the overall transfer efficiency for the toner image in black (K) is lower than the overall transfer efficiency for the toner images in the other regular colors.

Exemplary Embodiment

As seen from the graphs illustrated in FIGS. 1A and 1B, on the other hand, the overall transfer efficiency for the toner image in black (K) according to the exemplary embodiment is higher than the overall transfer efficiency for the toner image in black (K) according to the comparative embodiment. In the exemplary embodiment, as seen from the graph illustrated in FIG. 1A, the overall transfer efficiency for the toner image in black (K) is higher than the overall transfer efficiency for the toner image in yellow (Y) and the toner image in magenta (M). A current that flows from the first transfer roller 33V toward the photosensitive drum 21V for the special color (V) flows through the toner image in black (K) transferred onto the transfer belt 31. This increases the charge amount of the toner constituting the toner image in black (K).

In the exemplary embodiment, as discussed earlier, the current that flows from the first transfer roller 33V toward the photosensitive drum 21V for the special color (V) is reduced compared to the transfer current that flows from the first transfer rollers 33 toward the photosensitive drums 21 for the regular colors.

In the exemplary embodiment, a current flows from the first transfer roller 33V toward the photosensitive drum 21V for the special color (V) in the case where a toner image in the special color (V) is not formed.

In addition, the current that flows from the first transfer roller 33V toward the photosensitive drum 21V is reduced compared to the transfer current that flows from each first transfer roller 33 toward each photosensitive drum 21 for the regular colors in the case where toner images formed in the regular colors are transferred to the transfer belt 31.

Second Exemplary Embodiment

Next, an image forming apparatus according to a second exemplary embodiment of the present invention will be described with reference to FIGS. 6 and 7. Components that are the same as those according to the first exemplary embodiment are denoted by the same reference symbols to omit description thereof, and components that are different from those according to the first exemplary embodiment will be principally described.

Figure 7:
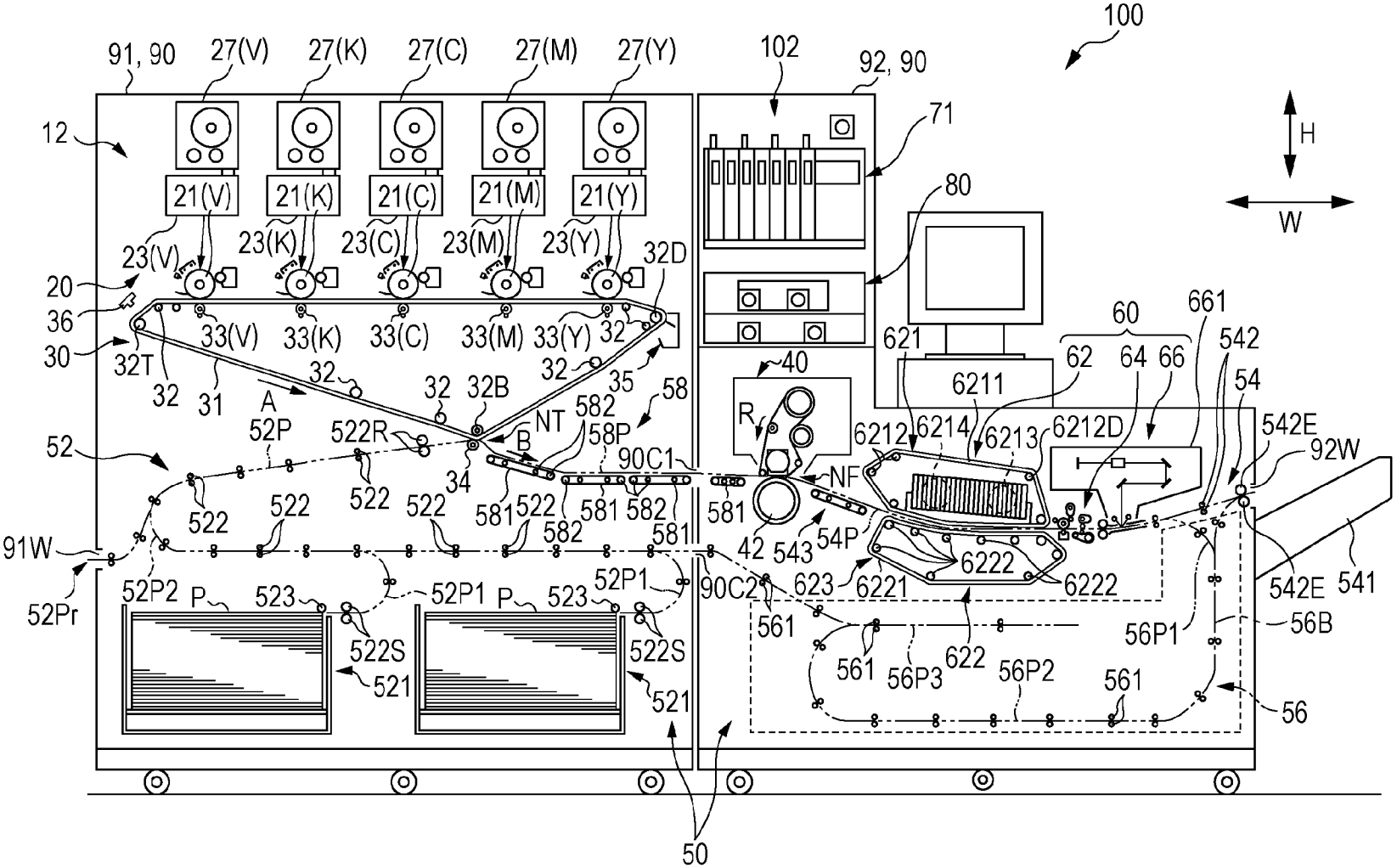
FIG. 7 illustrates a schematic configuration of the image forming apparatus according to the second exemplary embodiment of the present invention.

As illustrated in FIG. 7, an image forming apparatus 100 according to the second exemplary embodiment includes a humidity detection section 76 that detects the humidity in the first housing 91 (in the apparatus), and a temperature detection section 78 that detects the temperature in the first housing 91.

A controller 102 varies a current that flows from the first transfer roller 33V toward the photosensitive drum 21V in the case where a toner image in the special color (V) is not formed on the basis of the humidity detected by the humidity detection section 76 and the temperature detected by the temperature detection section 78.

Specifically, in the case where the detected humidity is equal to or more than a threshold determined in advance (for example, 85 [% RH]) and the detected temperature is equal to or more than a threshold determined in advance (for example, 28 [° C.]), the controller 102 increases the current that flows from the first transfer roller 33V toward the photosensitive drum 21V compared to that for a case where the detected humidity is less than the threshold or the detected temperature is less than the threshold.

Figure 6:
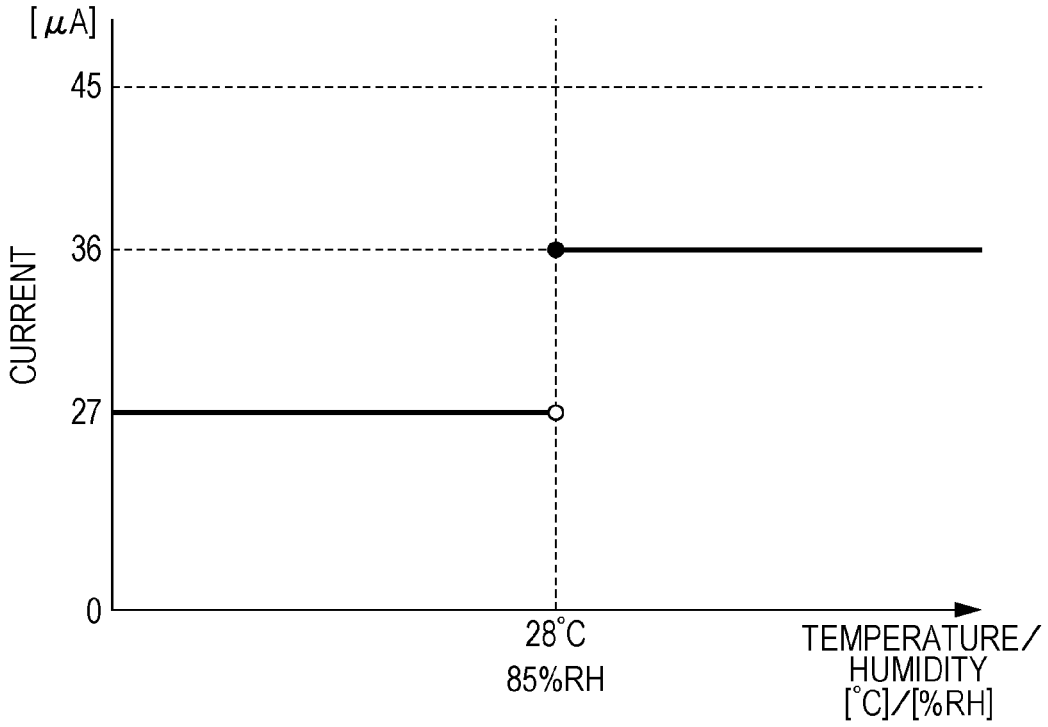
FIG. 6 is a graph indicating a current that flows between a first transfer roller and a photosensitive drum for a special color in an image forming apparatus according to a second exemplary embodiment of the present invention.

In the graph of FIG. 6, an example of a current that flows from the first transfer roller 33V toward the photosensitive drum 21V for a case where a toner image in the special color (V) is not formed is indicated. In the graph, the horizontal axis indicates the temperature and the humidity, and the vertical axis indicates the current (current value).

For example, a current that flows from the first transfer roller 33V toward the photosensitive drum 21V is 27 [μA] in the case where the detected humidity or the detected temperature is less than the threshold, and 36 [μA] in the case where the detected humidity and the detected temperature are equal to or more than the threshold. The transfer current that flows from each first transfer roller 33 to each photosensitive drum 21 for the regular colors is 45 [μA] as in the first exemplary embodiment.

The toner is rubbed against the carrier in the developing device 24 to be charged to a negative polarity (frictionally charged). Therefore, the charge amount of the toner is lowered in the case where the humidity and the temperature in the first housing 91 are high compared to the case where the humidity or the temperature is low.

As discussed earlier, however, the controller 102 increases the current that flows from the first transfer roller 33V toward the photosensitive drum 21V in the case where the detected humidity is equal to or more than a threshold determined in advance and the detected temperature is equal to or more than a threshold determined in advance, compared to that for a case where the detected humidity is less than the threshold or the detected temperature is less than the threshold. This increases the charge amount of the toner constituting the toner image in black (K) transferred onto the transfer belt 31 in the case where the detected humidity and the detected temperature are equal to or more than the threshold, compared to a case where the current that flows from the first transfer roller 33V toward the photosensitive drum 21V is not increased.

Therefore, it is possible to suppress a defect in transfer to the sheet member P of a toner image transferred to the transfer belt 31 by the first transfer roller 33V for black (K), which is disposed most downstream in the circulation direction of the transfer belt 31 (suppress a reduction in transfer efficiency). The other effects of the second exemplary embodiment are the same as those of the first exemplary embodiment.

Third Exemplary Embodiment

Figure 8:
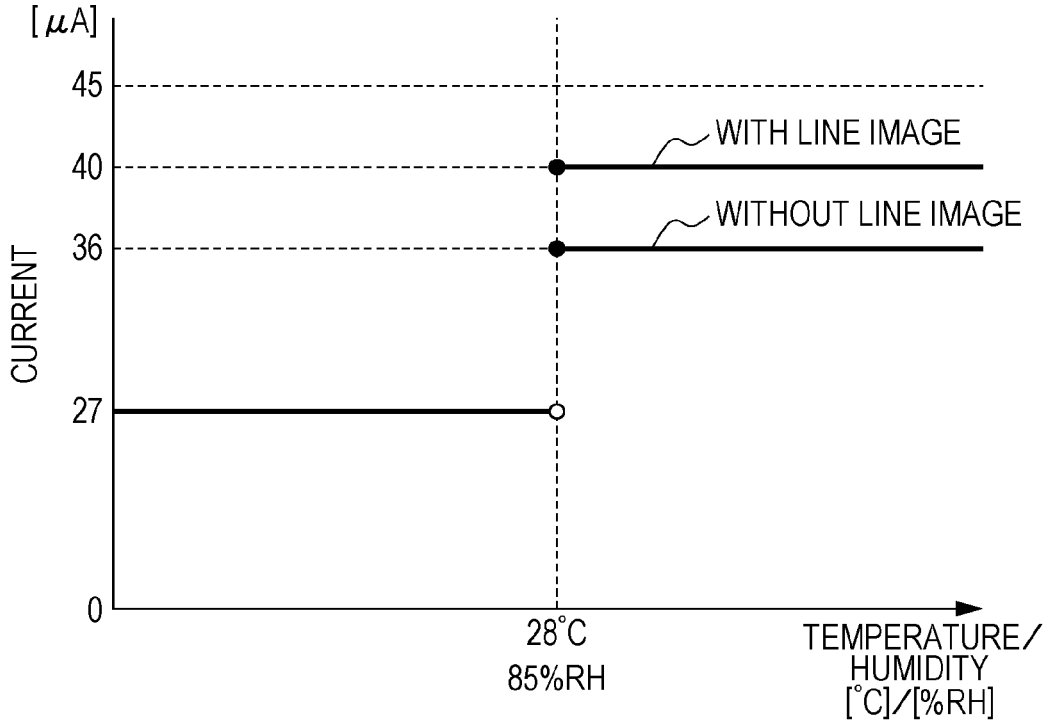
FIG. 8 is a graph indicating a current that flows between a first transfer roller and a photosensitive drum for a special color in an image forming apparatus according to a third exemplary embodiment of the present invention.

Next, an image forming apparatus according to a third exemplary embodiment of the present invention will be described with reference to FIGS. 8 and 9. Components that are the same as those according to the second exemplary embodiment are denoted by the same reference symbols to omit description thereof, and components that are different from those according to the second exemplary embodiment will be principally described.

A controller 104 according to the third exemplary embodiment varies a current that flows from the first transfer roller 33V toward the photosensitive drum 21V in the case where a toner image in the special color (V) is not formed on the basis of the results of the detection performed by the humidity detection section 76 and the temperature detection section 78 and an output image.

Specifically, in the case where the humidity and the temperature detected by the humidity detection section 76 and the temperature detection section 78, respectively, are equal to or more than a threshold determined in advance, the controller 104 (an example of an acquisition section) determines whether or not image data in black (K) to be subjected to image processing performed by the image signal processing section 71 contain a line image.

The controller 104 increases the current that flows from the first transfer roller 33V toward the photosensitive drum 21V in the case where the image data in black (K) contain a line image compared to a case where the image data in black (K) do not contain a line image. For example, as in the graph illustrated in FIG. 8, the controller 104 sets the current to 36 [μA] in the case where the image data in black (K) do not contain a line image, and sets the current to 40 [μA] in the case where the image data in black (K) contain a line image. The line image is a line with a width (thickness) of 0.5 to 1.5 [mm] and a length of 50 [mm]. If the charge amount of the toner is small in the case where the image data in black (K) contain a line image, a part of the line image tends to splatter (K line splattering) when the toner image is transferred to the sheet member P compared to a case where the charge amount of the toner is large.

Figures 9A, 9B, 9C:
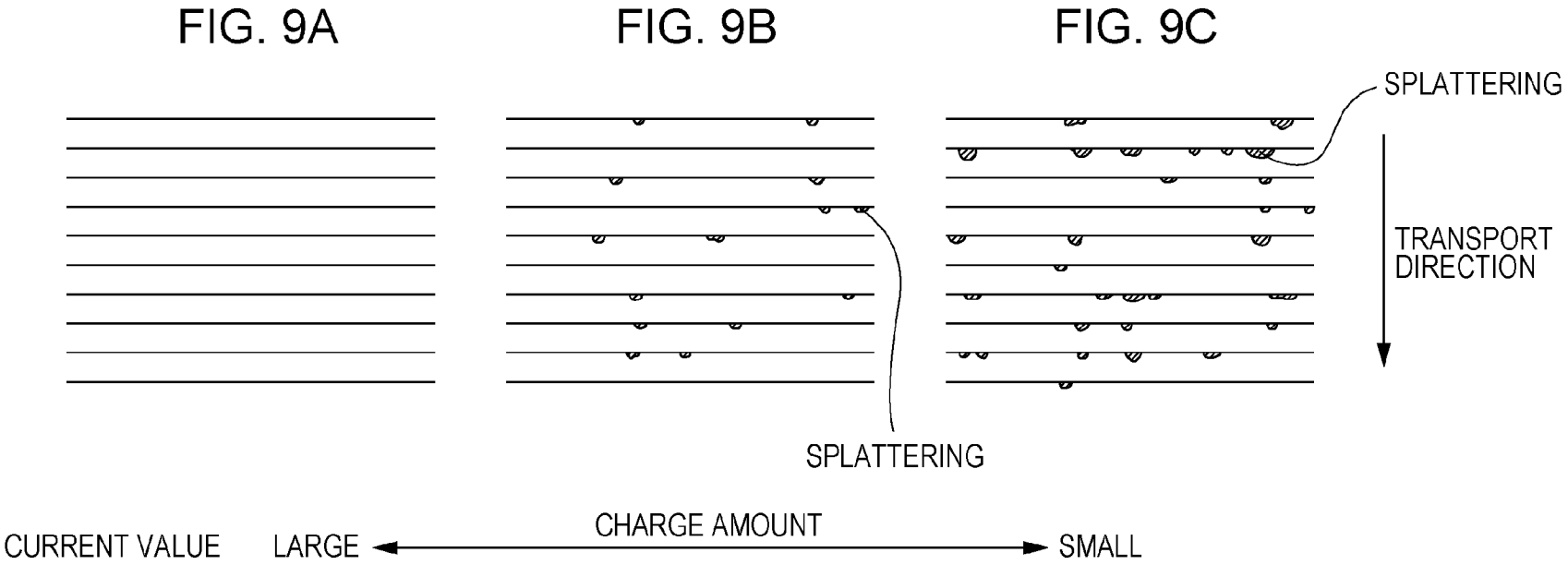
FIGS. 9A, 9B, and 9C are diagrams used to illustrate the effect of the image forming apparatus according to the third exemplary embodiment of the present invention, illustrating line images on a sheet member.

FIGS. 9A, 9B, and 9C illustrate images in which a line image in black (K) is transferred to the sheet member P with different charge amounts of the toner in the case where the humidity in the apparatus is equal to or more than 85 [% RH] and the temperature in the apparatus is equal to or more than 28 [° C.]. Lines with a width (thickness) of 0.25 [mm] extending in the sheet width direction and formed at a pitch of 3.5 [mm] are used as the line image.

FIGS. 9A, 9B, and 9C are arranged in the descending order of the charge amount of the toner. That is, FIG. 9A illustrates an image for a case where the charge amount of the toner is the largest, and FIG. 9C illustrates an image for a case where the charge amount of the toner is the smallest.

As discussed earlier, the controller 104 increases the current that flows from the first transfer roller 33V toward the photosensitive drum 21V in the case where the image data in black (K) contain a line image compared to a case where the image data in black (K) do not contain a line image.

While specific exemplary embodiments of the present invention have been described in detail above, the present invention is not limited to such exemplary embodiments. It is apparent to those skilled in the art that a variety of other exemplary embodiments may fall within the scope of the present invention. For example, in the exemplary embodiments described above, the first transfer rollers 33Y, 33M, 33C, 33K, and 33V are provided as a transfer section. However, only the first transfer rollers 33Y, 33M, 33C, and 33K may be provided as a transfer section.

Also in the configuration, a current flows through a transfer section disposed downstream even in the case where an image is not transferred to the transfer belt 31 at a transfer section (for example, Y) disposed most downstream.

In the exemplary embodiments described above, the special color (V) is a corporate color specific to a user that is used frequently compared to the other colors. However, the special color (V) may be a silver color or the like for which a toner containing flat metallic pigment particles for imparting a metallic luster to an image is used.

In the exemplary embodiments described above, among the first transfer rollers 33 for the regular colors, the first transfer roller 33K for black (K) is disposed most downstream in the circulation direction of the transfer belt 31. However, the first transfer roller 33 for yellow (Y), magenta (M), or cyan (C) may be disposed most downstream.

In the first exemplary embodiment described above, a two-component developer G containing a toner and a carrier is used as an example. However, a one-component developer G may also be used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an endless transfer member to which an image is transferred during circulation of the transfer member;

a plurality of transfer sections that transfer the image to a surface of the transfer member through a first transfer current, the transfer sections including a most-downstream transfer section provided most downstream in a circulation direction of the transfer member; and a medium transfer section that transfers the image transferred to the transfer member to a recording medium through a second transfer current, wherein a current flows through the most-downstream transfer section even in the case where the image is transferred to the transfer member by at least one of the transfer sections excluding the most-downstream transfer section, and the most-downstream transfer section does not transfer an image to the transfer member.

2. The image forming apparatus according to claim 1, wherein a current that flows through the most-downstream transfer section in the case where the most-downstream transfer section does not transfer an image to the transfer member is smaller than the first transfer current.

3. The image forming apparatus according to claim 1, wherein a current that flows through the most-downstream transfer section in the case where the most-downstream transfer section does not transfer an image to the transfer member is larger in the case where a humidity in the apparatus is equal to or more than a threshold determined in advance and a temperature in the apparatus is equal to or more than a threshold determined in advance, than that for a case where the humidity in the apparatus is less than the threshold or the temperature in the apparatus is less than the threshold.

4. The image forming apparatus according to claim 1, further comprising:

an acquisition section disposed adjacent to the most-downstream transfer section to acquire image information on the image transferred to the transfer member, wherein a current that flows through the most-downstream transfer section in the case where the most-downstream transfer section does not transfer an image to the transfer member is larger in the case where a humidity in the apparatus is equal to or more than a threshold determined in advance, a temperature in the apparatus is equal to or more than a threshold determined in advance, and the image information acquired by the acquisition section contains a line image that extends in a width direction of the transfer member, than that for a case where the humidity in the apparatus is equal to or more than the threshold, the temperature in the apparatus is equal to or more than the threshold, and the image information acquired by the acquisition section does not contain a line image.

5. The image forming apparatus according to claim 1, wherein the medium transfer section and plurality of transfer sections each comprises a transfer roller.

6. An image forming apparatus comprising:

a transfer belt;

a plurality of transfer rollers that transfer respective images onto the transfer belt using respective first transfer currents; and a second transfer roller that transfers an image formed by the respective images from the transfer belt onto a recording medium using a second transfer current, wherein the first transfer current of a most-downstream transfer roller of the plurality of transfer rollers flows through the most-downstream transfer roller in a case in which the most-downstream transfer roller does not transfer an image to the recording medium but at least one of the remaining transfer rollers does transfer an image to the recording medium.

7. The image forming apparatus of claim 6, wherein the first transfer current of the most-downstream transfer roller is smaller than the first transfer currents of the remaining transfer rollers in a case in which the most-downstream transfer roller does not transfer an image to the recording medium but the at least one of the remaining transfer rollers does transfer an image to the recording medium.

* * * * *